US006133169A

United States Patent [19]

Chiou et al.

[11] Patent Number: 6,133,169

[45] Date of Patent: Oct. 17, 2000

[54] PENETRATION-RESISTANT BALLISTIC ARTICLE

[75] Inventors: Minshon J. Chiou, Chesterfield, Va.; Jianrong Ren, Collex; Nicolas A. Van Zijl, Geneva, both of Switzerland

[73] Assignee: E. I. du Pont de Nemours and Company, Wilmington, Del.

[21] Appl. No.: 09/045,132

[22] Filed: Mar. 20, 1998

[51] Int. Cl.[7] ..... B32B 15/14

[52] U.S. Cl. ..... 442/234; 442/232; 442/378; 428/911

[58] Field of Search ..... 428/911; 442/232, 442/234, 378

[56] References Cited

U.S. PATENT DOCUMENTS

| | | | |
|---|---|---|---|
| 4,648,136 | 3/1987 | Higuchi | 2/2.5 |
| 4,660,223 | 4/1987 | Fritch | 2/2.5 |
| 4,930,832 | 6/1990 | Shelton | 296/107 |
| 5,086,561 | 2/1992 | Nathan | 30/1 |
| 5,185,195 | 2/1993 | Harpell et al. | 428/102 |
| 5,187,023 | 2/1993 | Prevorsek et al. | 428/911 |
| 5,198,280 | 3/1993 | Harpell et al. | 428/102 |
| 5,254,383 | 10/1993 | Harpell et al. | 428/68 |
| 5,362,527 | 11/1994 | Harpell et al. | 428/33 |
| 5,472,769 | 12/1995 | Goerz, Jr. et al. | 428/138 |
| 5,565,264 | 10/1996 | Howland | 428/229 |
| 5,578,358 | 11/1996 | Foy et al. | 428/104 |
| 5,601,895 | 2/1997 | Cunningham | 428/66.6 |
| 5,697,098 | 12/1997 | Miguel-Bettencourt et al. | 2/2.5 |

FOREIGN PATENT DOCUMENTS

| | | | |
|---|---|---|---|
| 850 479 | 10/1978 | Belgium . | |
| 0 089 537 A1 | 9/1983 | European Pat. Off. | F41H 1/02 |
| 0 640 807 A1 | 3/1995 | European Pat. Off. | F41H 1/02 |
| 0 670 466 A1 | 9/1995 | European Pat. Off. | F41H 5/04 |
| 35 15 726 | 11/1986 | Germany | F41H 1/02 |
| 94 08 834 | 9/1994 | Germany | D06N 7/00 |
| 91 06821 | 5/1991 | WIPO | F41H 1/02 |
| 92 20519 | 11/1992 | WIPO | B32B 3/16 |
| WO 93/00564 | 1/1993 | WIPO | F41H 5/04 |
| 93 21492 | 10/1993 | WIPO | F41H 1/02 |
| 97 24574 | 7/1997 | WIPO | F41H 1/02 |
| 98 05917 | 2/1998 | WIPO | F41H 1/02 |

*Primary Examiner*—Blaine Copenheaver
*Assistant Examiner*—Ula C. Ruddock

[57] ABSTRACT

A combination of layered structures is disclosed for protection from both ice pick and knife penetration and ballistic threats wherein there are flexible metallic based structures, tightly-woven fabric layers, and ballistic layers, all arranged such that the tightly-woven fabrics layers are nearer than the ballistic layers to the threat strike face of the structure.

16 Claims, No Drawings

PENETRATION-RESISTANT BALLISTIC ARTICLE

BACKGROUND OF THE INVENTION

1. Field of the Invention

It is well known that flexible garments made for protection from ballistic threats are not necessarily effective against stabbing by knives or sharp pointed instruments. The converse is also true—penetration resistant articles are not necessarily effective against ballistic threats. This invention relates to articles which provide protection from threats of ice pick and knife penetration and, also, ballistic threats.

2. Discussion of the Prior Art

U.S. Pat. No. 5,578,358, issued Nov. 26, 1996, on the application of Foy et al. discloses a penetration-resistant structure made from woven aramid yarns having particularly low linear density.

International Publication No. WO 93/00564, published Jan. 7, 1993, discloses ballistic structures using layers of fabric woven from high tenacity para-aramid yarn.

U.S. Pat. No. 5,472,769, issued Dec. 5, 1995, as an example of attempts to provide both puncture resistance and ballistic resistance, describes a combination of knitted aramid yarn layers and deflection layers of materials such as metal wire.

European Patent Application No. 670,466, published Sep. 6, 1995, describes a ballistic and stab-resistant system wherein the knife stab resistance is imparted by embedding chainmail in a polymer resin.

SUMMARY OF THE INVENTION

This invention relates to a knife and ice pick penetration resistant ballistic article comprising a flexible metallic based structure, a plurality of tightly-woven penetration resistant fabric layers, and a plurality of ballistic layers wherein the article has an inner surface and an outer surface and the plurality of tightly-woven penetration resistant fabric layers is located nearer than the plurality of ballistic layers to the outer surface, that is, to the strike face for the penetration threat. The flexible metallic based structure can be located anywhere in the article and the plurality of tightly-woven penetration resistant fabric layers is adjacent the flexible metallic based structure when the flexible metallic based structure is at the outer surface and the plurality of ballistic layers is nearer than the plurality of tightly woven penetration resistant fabric layers to the inner surface.

DETAILED DESCRIPTION

The protective article of this invention was specifically developed to provide "triple threat" protection from penetration by ice picks as well as knives in addition to protection from ballistic threats. It is becoming ever more important that police and security personnel have simultaneous protection from both types of penetration threats and ballistic threats in the same protective garment. The inventors herein have investigated penetration resistant articles and ballistic articles and have made startling discoveries relating to the combination of those articles.

While "triple threat" protection is an important part of this invention, there has, also, been development of new structures which afford improved ice pick and knife penetration resistance even without incorporation of the aforementioned ballistic layers.

As a general rule, flexible articles with ice pick penetration resistance are made using layers of fabric woven from yarn material with high tenacity and toughness; and the degree of ice pick penetration resistance is, among other things, a function of the linear density of the yarn and tightness of the weave. The lower the linear density of the yarn and the tighter the weave, the greater the ice pick penetration resistance. For example, it is known that excellent ice pick penetration resistant articles are made from aramid yarn having a linear density less than 500 dtex woven to a fabric tightness factor of at least 0.75.

"Fabric tightness factor" and "Cover factor" are names given to the density of the weave of a fabric. Cover factor is a calculated value relating to the geometry of the weave and indicating the percentage of the gross surface area of a fabric which is covered by yarns of the fabric. The equation used to calculate cover factor is as follows (from Weaving: Conversion of Yarns to Fabric, Lord and Mohamed, published by Merrow (1982), pages 141–143):

$d_w$=width of warp yarn in the fabric $d_f$=width of fill yarn in the fabric $P_w$=pitch of warp yarns (ends per unit length)

$p_f$=pitch of fill yarns $$C_w = \frac{d_w}{p_w}$$

$$C_f = \frac{d_f}{p_f}$$

$$\text{Fabric Cover Factor} = C_{fab} = \frac{\text{total area obscured}}{\text{area enclosed}}$$

$$C_{fab} = \frac{(p_w - d_w)d_f + d_w p_f}{p_w p_f} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor which is possible for a plain weave fabric is 0.75; and a plain weave fabric with an actual cover factor of 0.68 will, therefore, have a fabric tightness factor of 0.91. The preferred weave for practice of this invention is plain weave.

Flexible articles with knife penetration resistance have been made using a flexible metallic based structure in combination with an impact energy absorbing material or a secondary layer of stab-resistant material. The impact energy absorbing material or the secondary layer of stab-resistant material was necessary to bolster the performance of the flexible metallic based structure. Impact energy absorbing material could be a soft material with a thickness which is reduced dramatically on energy impact, such as, needle-punched felt textile material or non-textile materials such as rubber or elastomer sheets or foam. Secondary stab resistant material may be additional chainmail or flexible resin impregnated fabric of high strength fibers. The material used in combination with the metallic based structure was, when fabric in nature, either highly compressible or resin impregnated.

Flexible ballistic articles are made using enough layers of high tenacity and high toughness fiber material to be effective against a specified threat. The layers can include fibers of aramids, polyamides, polyolefins, or other fibers usually used for ballistic protection. Fabrics for ballistic protection generally use yarns with relatively high linear densities and, when woven, have little regard for tightness of weave, except to avoid extremely tight weaves to avoid damage of yarn fibers resulting from the rigors of weaving.

To make a protective structure effective for threats from both, penetration by stabbing and ballistic threats, there have been combinations of material as previously pointed out and described in U.S. Pat. No. 5,472,769. The inventors herein have discovered a different combination of materials which yields a remarkable improvement in protection against the triple threat of ice picks, knives, and ballistics.

The particular combination of this invention, utilizing special penetration resistant materials and ballistic material, exhibits a good ballistic protection and an ice pick and knife penetration resistance which is much greater than would be expected from the sum of the penetration resistance of the individual elements of the combination. The individual elements in the combination of this invention have a particular element-to-element relationship.

It has been discovered that the flexible metallic based structure, as used in the combination of this invention, does not require either an impact energy absorbing material or a secondary layer of stab resistant material of foam or compressible or resin impregnated fabric. The flexible metallic based structure can be located anywhere in the article of this invention. Typically, this structure will have interlocked rings or a combination of rings and plates. The metallic based structure may be made from steel or titanium or the like. The chainmail should be light and flexible, yet stab-resistant. There are no other special requirements for the chainmail, but if the chainmail is made from metallic rings, it is preferred that the metallic rings have a diameter of from about 1.0 mm to about 20 mm. The diameter of wire used to fabricate the rings may range from 0.2 to 2.0 mm.

The plurality of tightly woven fabric layers are made from yarns of high strength fibers wherein the yarns generally have a linear density of less than 500 dtex and, preferably, the individual filaments in those yarns have a linear density of 0.2 to 2.5 dtex and more preferably 0.7 to 1.7 dtex. These layers can be made from aramids, polyamides, polyolefins, or other fibers usually used for penetration resistance. The preferred material for these layers is para-aramid yarns. The preferred linear density for the yarns is 100 to 500 dtex and those yarns are preferably woven to a fabric tightness factor of 0.75 to 1.00 or, perhaps, higher, and, more preferably greater than 0.95. It is most preferred that the tightly woven fabric layers have a relationship between the yarn linear density (dtex) and the fabric tightness factor as follows:

$$Y>X6.25\times10^{-4}+0.69$$

wherein, Y=fabric tightness factor and X=yarn linear density, as disclosed in the aforementioned U.S. Pat. No. 5,578,358.

The plurality of ballistic layers can be woven or non-woven, and, if non-woven, can be unidirectional, uni-weave, or the like. The layers can be made from aramid, polyamide, polyolefin, or other polymers usually used for ballistic protection. The preferred construction for these ballistic layers is woven para-aramid yarns with a linear density of 50 to 3000 dtex. If woven, plain weave is preferred, although other weave types, such as basket weave, satin weave, or twill weave, can be used. The preferred para-aramid is poly(p-phenylene terephthalamide).

Yarns used in any of the fabric layers of this invention should exhibit a tenacity of greater than 20 grams per dtex and as much as 50 grams per dtex or more; an elongation to break of at least 2.2% and as much as 6 or more; and a modulus of at least 270 grams per dtex and as much as 2000 grams per dtex or more.

A combination of the three elements of this invention is made by placing the three together, in face to face relation, with other layer materials therebetween or not, as desired. Other layer materials which may be placed among the three elements include, for example, water proofing materials, anti-trauma materials, and the like. As has been stated, improved ice pick and knife penetration resistance can be obtained using only two of the elements in accordance with this invention. Also, it is understood that the outer surface, or strike face, of the article of this invention need not be the absolute outer surface or the exposed surface of the article. It is enough if the outer surface is the outer surface of the article of this invention. The same is true of the inner surface. The "inner surface" is intended to denote the inner surface of the article of this invention.

It has been discovered that a combination of the elements, in accordance with the present invention, produces ice pick and knife penetration resistances which are much greater than the sum of those penetration resistances which would be exhibited by the elements taken individually.

The gist of this invention resides in the discovery that a combination of different materials, when configured in one way, yields poor results and, when configured in another way, yields unexpectedly good results. The high knife penetration resistance of this invention is provided by the flexible metallic based structure without need for compressible or resin impregnated assisting layers, because the metallic based structure is in the article of this invention in combination with the other elements. The flexible metallic based structure can be located anywhere in the article. The high ice pick penetration resistance of this invention is provided by the tightly woven fabric layers and in order to realize the high ice pick penetration resistance, the tightly woven fabric layers must be situated nearer than the ballistic layers to the impact of the ice pick threat—the strike face. The high ballistic penetration resistance of this invention is provided by the ballistic layers which can be located anywhere in the article except that they cannot be situated at the strike face.

Given the above limitations on element location, it is understood that there are only three different arrangements for the three-element embodiment of this invention. Namely, from the outer surface, or the strike face, in: (1) metallic based structure, tightly woven layers, ballistic layers; (2) tightly woven layers, ballistic layers, metallic based structure; and (3) tightly woven layers, metallic based structure, ballistic layers.

Test Methods

Linear Density. The linear density of a yarn is determined by weighing a known length of the yarn. "dtex" is defined as the weight, in grams, of 10,000 meters of the yarn.

In actual practice, the measured dtex of a yarn sample, test conditions, and sample identification are fed into a computer before the start of a test; the computer records the load-elongation curve of the yarn as it is broken and then calculates the properties.

Tensile Properties. Yarns tested for tensile properties are, first, conditioned and, then, twisted to a twist multiplier of 1.1. The twist multiplier (TM) of a yarn is defined as:

$$TM=(\text{turns/cm})(dtex)^{1/2}/30.3$$

The yarns to be tested are conditioned at 25° C., 55% relative humidity for a minimum of 14 hours and the tensile tests are conducted at those conditions. Tenacity (breaking tenacity), elongation to break, and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn linear density.

Toughness. Using the stress-strain curve from the tensile testing, toughness is determined as the area (A) under the stress/strain curve up to the point of yarn break. It is usually determined employing a planimeter, to provide area in square centimeters. Dtex (D) is as described above under "Linear Density". Toughness (To) is calculated as $$To = A \times (FSL/CFS)(CHS/CS)(1/D)(1/GL)$$

where

FSL=full-scale load in grams

CFS=chart full scale in centimeters

CHS=crosshead speed in cm/min

CS=chart speed in cm/min

GL=gauge length of test specimen in centimeters

Digitized stress/strain data may, of course, be fed to a computer for calculating toughness directly. The result is To in dN/tex. Multiplication by 1.111 converts to g/denier. When units of length are the same throughout, the above equation computes To in units determined only by those chosen for force (FSL) and D.

Penetration Resistance. Ice pick penetration resistance is determined on a plurality of layers of the fabrics using an ice pick 18 centimeters (7 inches) long and 0.64 centimeter (0.25 inch) in shaft diameter having a Rockwell hardness of C-42. The tests are conducted in accordance with HPW test TP-0400.03 (Nov. 28 1994) from H. P. White Lab., Inc. The test samples, placed on a 10% gelatin backing, are impacted with the ice pick, weighted to 7.35 kilograms (16.2 pounds) and dropped from various heights until penetration of the sample under test is accomplished. Knife penetration resistance is determined using the same procedure as set out above except that the ice pick is replaced by a boning knife (made by Russell Harrington Cutlery, Inc., Southbridge, Mass., U.S.A.) with a single edged blade 15 cm (6 inches) long and about 2 cm (0.8 inch) wide, tapering toward the tip and having a Rockwell hardness of C-55. Results are reported as penetration energy (joules) by multiplying kilogram-meters, from the energy at the penetrating height, by 9.81.

Ballistics Performance. Ballistic tests of the multi-layer panels are conducted to determine the ballistic limit (V50) in accordance with MIL-STD-662e, except in the selection of projectiles, as follows: A panel to be tested is placed in a sample mount to hold the panel taut and perpendicular to the path of test projectiles. The projectiles are 9 mm full metal jacket hand-gun bullets weighing 124 grains, and are propelled from a test barrel capable of firing the projectiles at different velocities. The first firing for each panel is for a projectile velocity estimated to be the likely ballistics limit (VS50). When the first firing yields a complete panel penetration, the next firing is for a projectile velocity of about 15.5 meters (50 feet) per second less in order to obtain a partial penetration of the panel. On the other hand, when the first firing yields no penetration or partial penetration, the next firing is for a velocity of about 15.2 meters (50 feet) per second more in order to obtain a complete penetration. After obtaining one partial and one complete projectile penetration, subsequent velocity increases or decreases of about 15.2 meters (50 feet) per second are used until enough firings are made to determine the ballistics limit (V50) for that panel.

The ballistics limit (V50) is calculated by finding the arithmetic mean of an equal number of at least three of the highest partial penetration impact velocities and the lowest complete penetration impact velocities, provided that there is a difference of not more than 38.1 meters (125 feet) per second between the highest and lowest individual impact velocities.

CONTROL EXAMPLES 1–4

Tests for these control examples were conducted using various tightly woven and ballistic layers of aramid control yarn. The yarn was poly (p-phenylene terephthalamide) yarn sold by E. I. du Pont de Nemours and Company under the trademark, Kevlar ®.

The tightly woven penetration resistant element was made using ten (10) layers of fabric woven from 220 dtex aramid yarn with a tenacity of 24.3 grams per dtex, a modulus of 630 grams per dtex, and elongation at break of 3.5%, in a plain weave at 27.5×27.5 ends per centimeter and a fabric tightness factor of 0.995. The element had an areal density of 1.27 kg/m$^2$ (identified as "A" below).

The ballistic element was made using eighteen (18) layers of fabric woven from 930 dtex aramid yarn with a tenacity of 24.0 grams per dtex, a modulus of 675 grams per dtex, and elongation at break of 3.4%, in a plain weave at 12.2×12.2 ends per centimeter and a fabric tightness factor of 0.925. This element had an areal density of 4.00 kg/m$^2$ (identified as "B" below).

The object of these control examples was to provide a data foundation for ice pick and knife penetration resistance without use of the flexible metallic based structure.

The layers were tested individually and in combination for ice pick and knife penetration resistance and, in two cases, ballistic limit. The combination was made by placing the elements together face-to-face. Results of the tests are shown in the table where "outer face" represents the strike face for the tests.

| Control | Outer | Inner | Penetration Energy (joules) | | Ballistic Limits V50 |
|---|---|---|---|---|---|
| Example | Face | Face | Ice Pick | Knife | (m/sec) |
| 1 | B | No | 0.8 | 4.5 | 442 |
| 2 | A | No | 20.1 | 1.8 | — |
| 3 | B | A | 3.7 | 8.5 | — |
| 4 | A | B | 137 | 8.5 | 478 |

Penetration energy is the test result, in joules, for the Penetration Resistance Test described in the Test Methods. Note that the ballistic element alone ("B") exhibited little resistance to ice pick penetration and relatively little resistance to knife penetration. The "A" element alone exhibited respectable ice pick resistance and very little knife resistance. When A and B were combined for testing with B as the strike face, ice pick and knife resistances were both low.

When A and B were combined for testing with A as the strike face, the ice pick resistance was very high.

EXAMPLES 5–9

Tests for the following examples were conducted using the same elements, A and B as were used in Control Examples 1–4; and flexible metallic based structures were used as follows:

C1—1 layer of chainmail sheet which had four welded rings of 0.8 mm diameter stainless steel passing through each ring and a basis weight of 3.19 kg/m$^2$.

C2—1 layer of chainmail sheet which had four welded rings of 0.9 mm diameter stainless steel passing through each ring and a basis weight of 4.11 kg/m$^2$.

Various combinations of the elements were tested for ice pick and knife penetration resistance and, in two cases, ballistic limit. Results of the tests are shown in the table where "outer face" represents the strike face for the test.

| | | | | Penetration Energy (joules) | | Ballistic |
|---|---|---|---|---|---|---|
| Example | Outer Face | Middle Face | Inner Face | Ice Pick | Knife | Limits V50 (m/sec.) |
| 5 | C1 | A | B | 114 | >180 | 473 |
| 6 | B | C1 | A | 7.3 | 54.2 | 469 |
| 7 | A | C1 | B | 114 | 164.7 | — |
| 8 | C2 | A | B | 128.3 | >180 | — |
| 9 | B | C2 | A | 12.8 | 137.3 | — |

It is noted that, in comparison with the Control Examples, addition of the flexible metallic based structures greatly improves the knife penetration resistance. However, the most significant factor, and most indicative of one embodiment of this invention, resides in the increased knife penetration resistance which is obtained when the tightly woven element (A)is located nearer than the ballistic element (B) to the strike face. Compare Examples 5 and 6, Examples 7 and 6, and Examples 8 and 9.

EXAMPLES 10 AND 11

Tests for the following examples were conducted using the same elements, A and B, as were used herein before and the flexible metallic based structure was:

C3—1 layer of aluminum plates about 2 cm×2.5 cm×0.1 cm held together by rings passing through each corner of each plate and a basis weight of 4.13 kg/m$^2$.

Various combinations of the elements were tested for ice pick and knife penetration resistance. Results of the tests are shown in the table where "outer face" represents the strike face for the tests.

| | | | | Penetration Energy (joules) | |
|---|---|---|---|---|---|
| Example | Outer Face | Middle Face | Inner Face | Ice Pick | Knife |
| 10 | C3 | A | B | >180 | >180 |
| 11 | B | C3 | A | 45.8 | 173.9 |

It is noted that, while C3 provides improvement for ice pick and knife penetration resistance in both of the tested configurations compared with the same configuration using C1 and C2 in previous examples, the knife penetration resistance is most improved using the configuration where the tightly woven element (A) is located nearer than the ballistic element (B) to the strike face.

CONTROL EXAMPLES 12 AND 13 AND EXAMPLE 14

Tests were conducted with an aim toward improved ice pick and knife protection omitting the ballistic element from the article.

The flexible metallic based structure was the chainmail element Cl from Example 5 and the tightly-woven penetration resistant fabric layers was designated "A1" and was the same as element A, above, but was made using thirty (30) layers of the fabric instead of ten (10) and had an areal density of 3.81 kg/m r$^2$.

Also, as one component in a Control Example, there was used an aramid fabric structure which was made using yarns of aramid fiber woven from 930 dtex aramid yarn with a tenacity of 24.0 grams per dtex, a modulus of 675 grams per dtex, and elongation to break of 3.4%, in a plain weave at 12.2×12.2 ends per centimeter and a fabric tightness factor of 0.925. Thirty (30) layers were used and the components had an areal density of 6.81 kg/m2 (identified as A2).

Various combinations of A1, A2, and C1 were tested for ice pick and knife penetration resistance. Results of the tests are shown in the table below.

| | | | Penetration Energy (joules) | |
|---|---|---|---|---|
| Example | Outer Face | Inner Face | Ice Pick | Knife |
| Control 12 | A1 | Nothing | >180 | 9.0 |
| Control 13 | C1 | A2 | 3.7 | >180 |
| 14 | C1 | A1 | >180 | >180 |

It is noted that, while A1 provides ice pick penetration resistance, the combination of C1 and layers of an aramid fabric not so tightly-woven provide very little ice pick penetration resistance. The combination of C1 and A1, as an article of this invention, exhibits remarkably good penetration resistance to both, ice picks and knives.

What is claimed is:

1. A knife and ice pick penetration resistant ballistic article comprising a flexible metallic based structure, a plurality of tightly-woven penetration resistant fabric layers, the fabric woven to a fabric tightness factor of at least 07.5, and a plurality of ballistic layers wherein the article has an outer surface and an inner surface and the flexible metal based structure is located anywhere in the article, the plurality of tightly-woven penetration resistant fabric layers is located at the outer surface or adjacent the flexible metal based structure when the flexible metal based structure is at the outer surface, and the plurality of ballistic layers is nearer than the plurality of tightly-woven penetration resistant fabric layers to the inner surface.

2. A knife and ice pick penetration resistant ballistic article comprising a flexible metallic based structure, a plurality of tightly-woven penetration resistant fabric layers, and a plurality of ballistic layers wherein the article has an outer surface and the plurality of tightly-woven penetration resistant fabric layers is located nearer than plurality of ballistic layers to the outer surface.

3. The article of claims 1 or 2 wherein the outer surface is the strike face for penetration threats.

4. The article of claims 1 or 2 wherein the tightly-woven penetration resistant layers comprise fabric woven from aramid yarn having a linear density of less than 500 dtex.

5. The article of claim 4 wherein the aramid yarn is para-aramid yarn.

6. The article of claim 4 wherein the yarn of the penetration resistant layers has a linear density of 0.7 to 1.7 dtex.

7. The article of claims 1 or 2 wherein the tightly-woven penetration resistant layers comprise fabric woven from aramid yarn having a linear density of less than 500 dtex and characterized by having the fabric woven to a fabric tightness factor of at least 0.95

8. The article of claims 1 or 2 wherein the ballistic layers are made from fibers exhibiting elongation to break of greater than 2.2%, a modulus of greater than 270 grams per dtex, and tenacity greater than 20 grams per dtex.

9. The article of claim 8 wherein fibers of the ballistic layers are yarns having a linear density of 50 to 3000 dtex.

10. The article of claim 9 wherein the yarns of the ballistic layers are woven.

11. The article of claim 9 wherein the yarns of the ballistic layers are non-woven.

12. The article of claim 9 wherein the yarns of the ballistic layers are para-aramid.

13. The article of claim 9 wherein the yarns of the ballistic layers are polyethylene.

14. The article of claims 1 or 2 wherein the flexible metallic based structure comprises interlocked metal rings or metal plates or a combination of metal rings and plates.

15. A knife and ice pick penetration resistant article comprising a flexible metallic based structure and a plurality of tightly-woven penetration resistant fabric layers woven from aramid yarn having a linear density of less than 500 dtex and characterized by having the fabric woven to a fabric tightness factor of at least 0.95.

16. The article of claim 15 wherein the flexible metallic based structure comprises interlocked metal rings or metal plates or a combination of metal rings and plates.

* * * * *